US010183302B2

(12) United States Patent
Shin

(10) Patent No.: US 10,183,302 B2
(45) Date of Patent: Jan. 22, 2019

(54) MICRO FOGGING DEVICE AND METHOD

(71) Applicant: Hong Kun Shin, Miryang-si (KR)

(72) Inventor: Hong Kun Shin, Miryang-si (KR)

( * ) Notice: Subject to any disclaimer, the term of this patent is extended or adjusted under 35 U.S.C. 154(b) by 166 days.

(21) Appl. No.: 15/001,603

(22) Filed: Jan. 20, 2016

(65) Prior Publication Data

US 2016/0263595 A1 Sep. 15, 2016

(30) Foreign Application Priority Data

Mar. 13, 2015 (KR) ..... 10-2015-0035269
Sep. 17, 2015 (KR) ..... 10-2015-0131879

(51) Int. Cl.

*B05B 7/04* (2006.01)
*B05B 1/02* (2006.01)
*B05B 1/34* (2006.01)
*B05B 7/06* (2006.01)

(52) U.S. Cl.

CPC ..... *B05B 7/0416* (2013.01); *B05B 1/02* (2013.01); *B05B 1/3415* (2013.01); *B05B 1/3436* (2013.01); *B05B 1/3468* (2013.01); *B05B 7/064* (2013.01)

(58) Field of Classification Search

CPC ..... B05B 7/0416; B05B 7/064; B05B 1/02; B05B 1/3415; B05B 1/3436; B05B 1/3468; B05B 1/3442; B05B 1/3447; B05B 7/10; B05B 1/3478; B05B 15/65; B05B 1/3405; B05B 7/0025; B05B 7/0458; B05B 7/0483; B05B 1/262; B05B 1/34–1/3494

USPC ... 239/8, 399, 403, 421, 500, 501, 434, 433, 239/426

See application file for complete search history.

(56) References Cited

U.S. PATENT DOCUMENTS 3,692,245 A * 9/1972 Needham ..... B05B 1/3442 239/488
3,823,872 A * 7/1974 Frenzl ..... F04F 5/02 239/424.5
5,857,626 A * 1/1999 Hsu ..... B05B 1/3006 239/381
5,934,569 A * 8/1999 Soule ..... B05B 1/3442 239/468
7,475,831 B2 * 1/2009 Van Steenkiste ..... B05B 7/1486 118/308

(Continued)

FOREIGN PATENT DOCUMENTS

JP 2013-81924 A 5/2013
KR 20-0419612 Y1 6/2006

(Continued)

*Primary Examiner* — Darren W Gorman
*Assistant Examiner* — Juan C Barrera
(74) *Attorney, Agent, or Firm* — Park & Associates IP Law, P. C.

(57) ABSTRACT

The present invention relates to micro fogging device and method which can spray micro fog-like fine water droplet to be used, for example, for protected cultivation, such as green houses, or barns. The micro fogging device can supply fog tinier than the conventional low pressure foggers, and includes: a low pressure fogger unit for forming fog at low pressure; and a venture nozzle which is coupled to a coupling pipe of the low pressure fogger unit to finely segment/divide the water droplets supplied from the low pressure fogger unit, thereby minimizing usage of water and compressed air and maximizing the effectiveness of fog generation.

1 Claim, 15 Drawing Sheets

(56) References Cited

U.S. PATENT DOCUMENTS

| | | | | |
|---|---|---|---|---|
| 2010/0276517 | A1* | 11/2010 | Alansary | B05B 7/0416 239/399 |
| 2011/0127347 | A1* | 6/2011 | Worthy | B01F 5/0077 239/8 |
| 2013/0153688 | A1* | 6/2013 | Hsieh | A62C 31/02 239/589 |
| 2015/0048176 | A1* | 2/2015 | Jones | A62C 5/008 239/8 |

FOREIGN PATENT DOCUMENTS

| | | | |
|---|---|---|---|
| KR | 10-2006-0128289 | A | 12/2006 |
| KR | 20-2010-0000840 | U | 1/2010 |
| KR | 10-2010-0035839 | A | 4/2010 |
| KR | 10-2010-0077370 | A | 7/2010 |
| KR | 10-2010-0104973 | A | 9/2010 |
| KR | 10-1232340 | B1 | 2/2013 |

* cited by examiner

MICRO FOGGING DEVICE AND METHOD

REFERENCE TO RELATED APPLICATIONS

This application claims the priority benefit of Korean Patent Application No. 10-2015-0131879 filed on Sep. 17, 2015, and Korean Patent Application No. 10-2015-0035269 filed on Mar. 13, 2015, the entire contents of which are incorporated herein by reference.

FIELD OF THE INVENTION

The present invention relates to a micro fogging device and method thereof, and more particularly, to a micro fogging device and method which can form fog tinier than low pressure fogger used generally, thereby minimizing usage of water and compressed air, maximizing fog effectiveness and being applied for protected cultivation in greenhouses or for various use purposes, such as for watering, for humidification or for control of temperature, in industrial facilities.

BACKGROUND OF THE INVENTION

Generally, a fogging device, which produces fine water particles like fog, is located in a green house or a barn in which a variety of vegetables, garden products, or farm animals are cultivated or raised to spray chemical liquid or adjust humidity and temperature thereinto.

A plastic fogging device used generally includes: a fixing body having coupling holes to which posts are coupled formed on one side or both sides thereof or in every direction thereof, a hose coupling pipe to which an insertion pipe and a hose are respectively fitted on the upper and lower sides thereof, and locking projections formed on both sides of the insertion pipe; a nozzle fixture having a I protrusion formed on the lower end periphery thereof in such a manner as to be coupled to the locking projections of the fixing body and handles protruding from both sides of the upper portion thereof; a nozzle adapted to be inserted into a nozzle insertion hole having a locking projection penetrating into the nozzle fixture; and a nipple screw-coupled to the nozzle fixture and having a fixing portion formed on the upper side thereof to pressurize the nozzle and a passage adapted to supply water from the insertion pipe to the nozzle.

The nozzle includes: a body having a locking step from which a protruding round rim protrudes to come into contact with the locking projection formed on the nozzle insertion hole; a nipple induction projection formed on the lower periphery of the body; a conical vortex space formed on the inner face of the body to supply water to a nozzle hole, which is formed on the upper end thereof, in the form of vortex; and one passage formed underneath the vortex space to guide the water to the vortex space from the outside of the body in the form of vortex. Further, the insertion hose of the fixing body and the nipple are coupled to be spaced apart from each other in their assembled state. According to the conventional plastic fogging device, when the nipple is disassembled and assembled to clean the nozzle, the nozzle is not rigidly pressurized upon the abrasion of the screw of the nipple, and even when the nozzle fixture and the nozzle are brought into close contact with each other, because the locking projection formed on the nozzle insertion hole at the inner face of the nozzle fixture and the protruding round rim formed on the locking step on the body of the nozzle are in point contact with each other, if a fine scar occurs on the protruding round rim, functionality of the nozzle may be deteriorated.

In order to remove the above-mentioned problems, the same inventor as the present invention proposed a plastic fogging device disclosed in Korean Utility Model Registration No. (Y1)20-0419612 (issued on Jun. 21, 2006). In Korean Utility Model Registration No. (Y1)20-0419612, a nozzle fixture and a nozzle get in surface contact with each other, and in the state where a nipple is coupled to the nozzle fixture, the lower end periphery of the nipple comes into contact with an insertion hose formed on the upper end periphery of a fixing body, so that the nozzle is always fixed under the same conditions. Further, the nozzle has a straight pipe portion formed underneath the vortex space in such a manner as to have the same height as a plurality of passages guiding water to the vortex space, thus enhancing water supply and fogging efficiency even under low pressure.

In the meantime, various technologies for generating fog have been proposed, and as a presentative example, there is a fog nozzle disclosed in Korean Patent Publication No. 10-2010-0035839 published on Apr. 7, 2010. The fog nozzle includes: a nozzle body having a jet orifice formed in one end thereof for spraying a fluid and a coupling hole formed in the inner peripheral surface of the other end thereof; a pressure pin having a head which is formed on an end thereof, has a guide hole and is inserted and joined into the inner peripheral surface of the other end of the nozzle body; an elastic body joined with the other end of the pressure pin; and a strainer whose one end has an inner peripheral surface to which the other end of the elastic body is inserted and an outer peripheral surface inserted and coupled to the coupling hole of the nozzle body, the strainer having inflow holes formed in the outer peripheral surface of the other end thereof for allowing inflow of the fluid.

As another example, Korean Patent No. 10-1232340 issued on Feb. 13, 2013 discloses an air fog generator. The air fog generator includes: a cylindrical first housing having a water supply port and a conical second housing having an air supply port and a nozzle port; the first housing and the second housing being screw-coupled to each other; a hydraulic adjustor provided in the inside of the housing to uniformly adjust pressure of water supplied and supply the adjusted water to the nozzle port; and a gas-liquid mixing unit provided in the inside of the housing to mix liquid discharged from the hydraulic adjustor with air flowing in through the air supply port and spray fine water drops through the nozzle port, wherein discharge pressure of the hydraulic adjustor is higher than air pressure of the gas-liquid mixing unit.

As a further example, Korean Patent Publication No. 10-2006-0128289 on Dec. 14, 2006 discloses an ultrafine water spray nozzle. In Korean Patent Publication No. 10-2006-0128289, a gas passage is mounted by a partition wall fit to the outer periphery of a liquid passage. The gas passage communicates with a spray port. The section of the gas passage formed at the spray port of the partition wall is formed in a deformed shape of a polygon, a long circle, or an oval, and the section of the outer peripheral surface of the gas passage is formed in a shape of a circle. The deformed outer surface of the partition wall comes into contact with the outer peripheral surface of the circular section at plural spots so that the gas passage formed at the spray port part is divided into plural gas passages in a peripheral direction. Alternatively, the section of the outer surface of the partition wall is formed in a shape of a circle, and the section of the outer peripheral surface of the spray port of the gas passage is formed in a deformed shape of a polygon, a long circle, or an oval. The outer peripheral surface of the partition wall comes into contact with the outer surface of the spray port of the gas passage at plural spots so that the gas passage formed at the spray port part is divided into plural gas passages in a peripheral direction. Therefore, the gas sprayed from the spray port of the divided gas passages is mixed with the liquid sprayed from the liquid passage and the mixture can be sprayed.

However, the conventional fog generators have several disadvantages in that there is a limit in providing micro-state fog because they form fog by pulverizing water (liquid) just once, and in that it is difficult to apply them to general farms at a low price because most of the fog generators using compressed air are an injector type which is complex in structure.

Meanwhile, the conventional fog products can make very tiny micro fog when a vortex body structure is applied to the structure that water is continuously supplied like the prior arts and high pressure is applied to the structure, but because the high pressure fog has a hole size of 0.1 mm to 0.3 mm, the high pressure fog is stopped by foreign matters floating in the water or calcium ions or iron ions dissolved in the water and is almost impossible to clean.

Furthermore, the low pressure micro fog is the method of finely pulverizing particles by continuously supplying water into a venturi space using twin-fluid. However, the low pressure micro fog also has a disadvantage in that it has to use a lot of air. So, capacity of a compressor must be increased.

Additionally, a conventional fog which pulverizes water by the micro unit using a flow rate of air flowing at high pressure when a flow direction of water is the same as a direction of the air also has several disadvantages in that capacity of the compressor must be increased because it consumes lots of compressed air, in that water must be drained off from the pipe because dripping water may be generated after use and it has a complicated structure and is spread at a high price because a dripping water preventing structure must be inserted into the fog.

SUMMARY OF THE INVENTION

Accordingly, the present invention has been made in view of the above-mentioned problems occurring in the prior art, and it is an object of the present invention to provide micro fogging device and method which can first form water particles like fog using a low pressure fogger and second form micro fog through a method of pulverizing the fog-like water particles supplied discontinuously using the venturi principle, thereby minimizing usage of water and compressed air, maximizing fog effectiveness, being capable of being produced and spreading at low price, and spraying fine water particles such as fog by being applied for protected cultivation in greenhouses or for various use purposes, such as for watering, for humidification or for control of temperature, in industrial facilities.

To accomplish the above-mentioned object, according to a first aspect of the present invention, there is provided a micro fogging device including: a low pressure fogger for forming fog; and a venturi nozzle for finely pulverizing water particles discontinuously supplied from the low pressure fogger, the venturi nozzle including a body, a venturi tube having an inflow hole through which compressed air flows in and an expansion part connected with the inflow hole by a throttle ring inside a spray pipe, a first coupler and spray pipe formed on the body on the same axial line in a straight form so that the venturi tube is formed, a second coupler formed at right angles to the first coupler, and a flow path communicating with a coupling pipe of the low pressure fogger to be connected with the throttle ring, wherein the low pressure fogger and the venturi nozzle are coupled in such a way that the coupling pipe protruding from a nozzle body of the low pressure fogger is forcedly fit to the second coupler of the venturi nozzle.

According to the present invention, at least one of a fluid induction member or the nozzle body of the low pressure fogger or the venturi nozzle is molded with synthetic resin mixed a silver nano material or an antimicrobial to eradicate germs.

To accomplish the above-mentioned object, according to a second aspect of the present invention, there is provided a micro fogging method including: a first step of first pulverizing water to form water particles through a low pressure fogger; and a second step of second pulverizing the first pulverized water particles in a venturi nozzle by inducing the first pulverized water particles discontinuously provided from the low pressure fogger to the venturi nozzle to which the venturi principle is applied so as to obtain micro water particles.

The micro fogging device and method according to the present invention can provide micro fog of high efficiency at low cost.

That is, the present invention can produce fog-like fine water particles by re-pulverizing fine water particles provided from the low pressure fogger by the venturi nozzle, thereby minimizing usage of water and maximizing fog efficiency.

In a case that the present invention is applied to protected cultivation, such as greenhouses, the present invention can uniformly spray a medicinal fluid to the entire plants because finely spraying the medicinal fluid in the air.

Moreover, the present invention can provide easy humidification for farming or for industrial use because providing micro-state fog, and improve a flow of air to be favorable for reducing the indoor temperature when it is installed at a ventilation side of an industrial facility in the summer season.

Furthermore, the present invention can prevent inhabitation of germs in remaining water because the nozzle body or the fluid induction member of the low pressure fogger or the venturi nozzle are made with the silver nano material, thereby solving the problems by germs when the present invention is used for humidification.

Additionally, the present invention can minimize supply of compressed air because the venturi nozzle pulverizes again the water particles first pulverized in the low pressure fogger, thereby forming micro fog using a small-sized air compressor.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Hereinafter, an explanation on micro fogging device and method according to the present invention will be in detail given with reference to the attached drawing.

Figure 1:
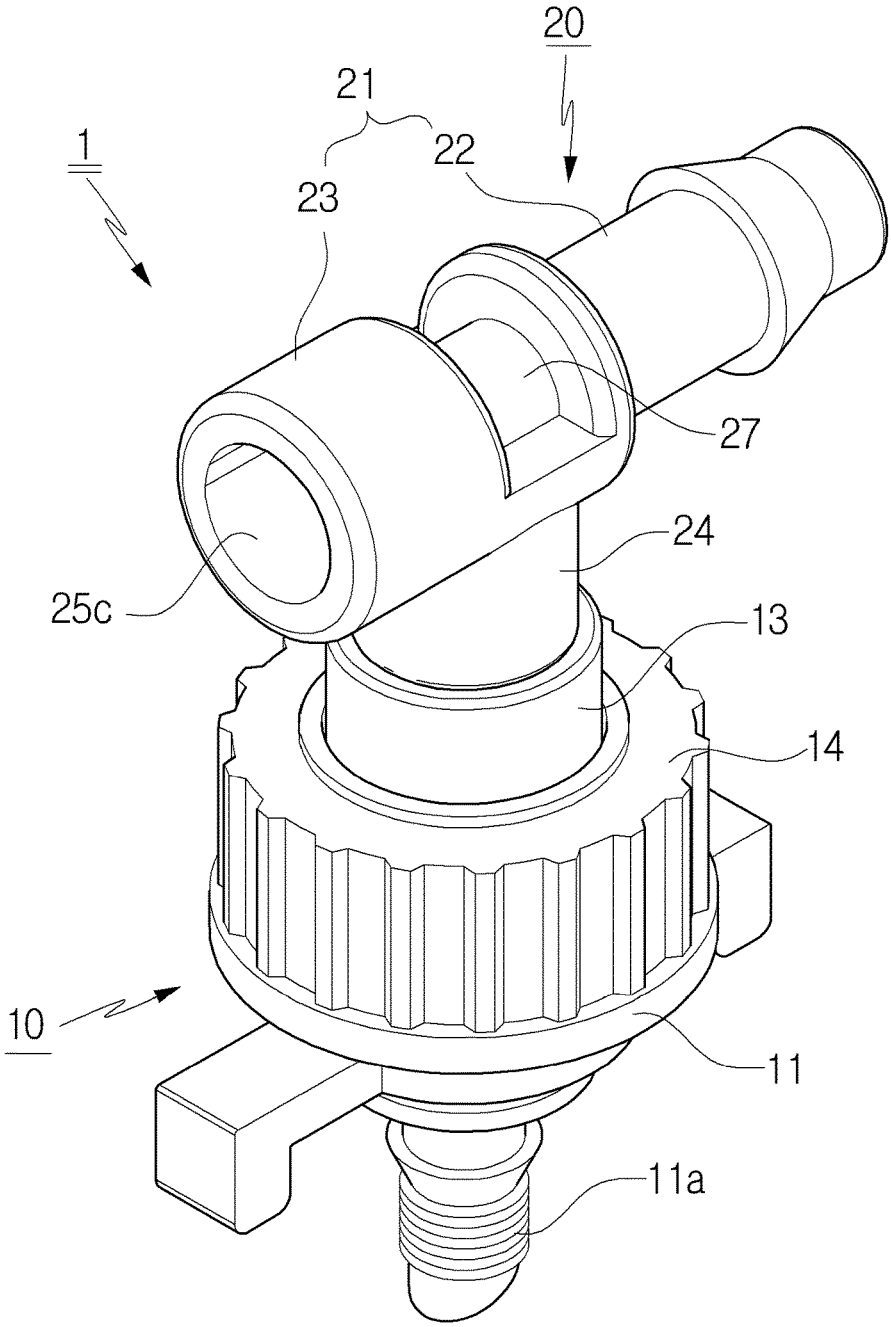
FIG. 1 is a perspective view showing an outward appearance of a micro fogging device according to a preferred embodiment of the present invention.
Figure 2:
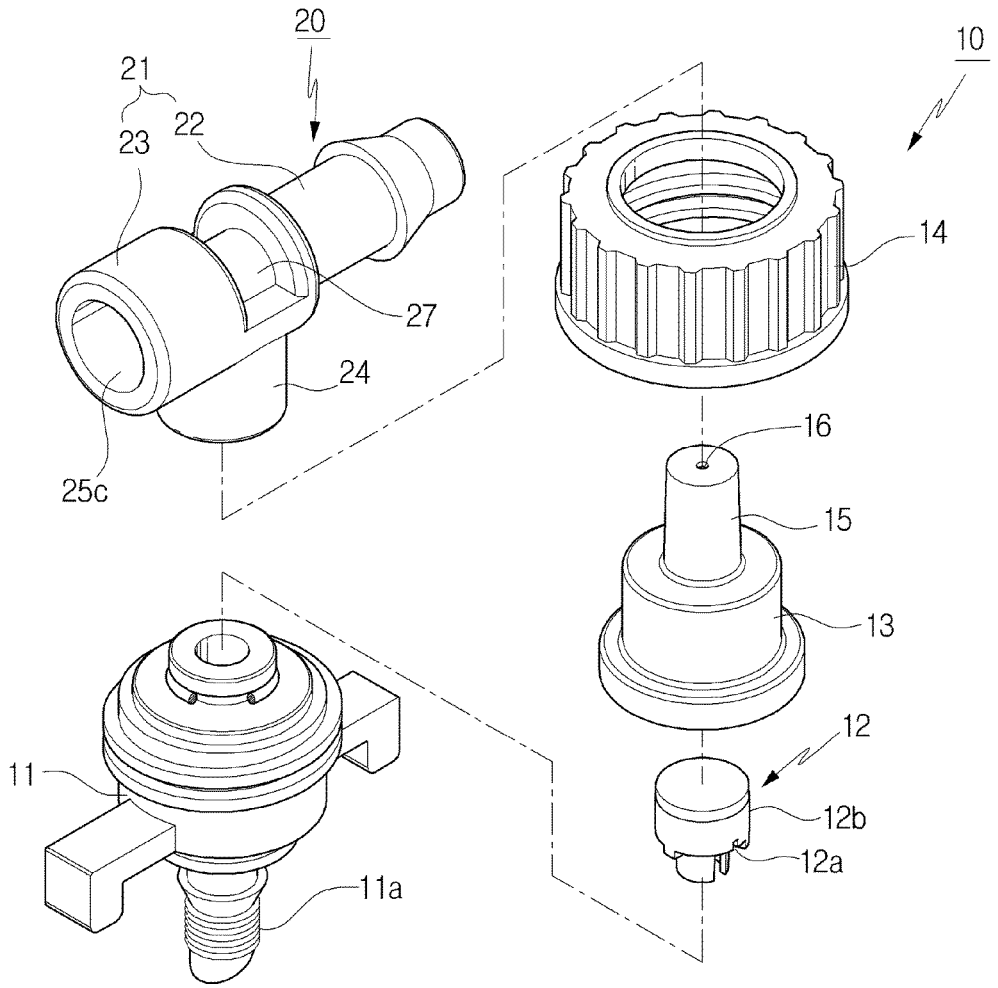
FIG. 2 is an exploded perspective view of the micro fogging device according to the preferred embodiment of the present invention.
Figure 2A:
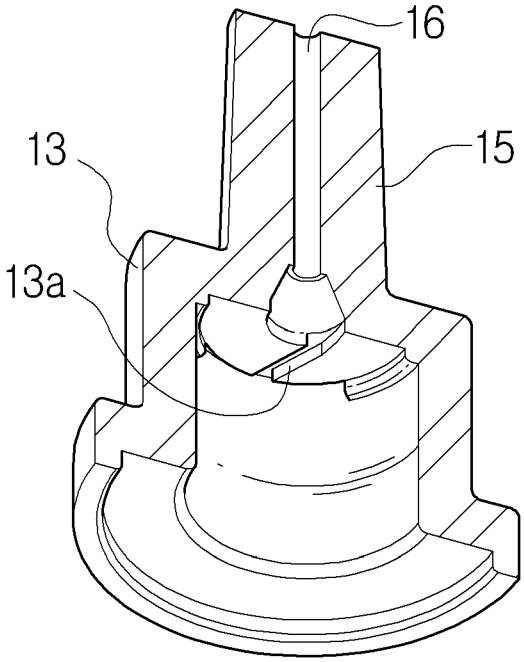
FIG. 2*a* is a bottom prospective and sectional view of the nozzle body of the micro fogging device according to the preferred embodiment of the present invention.
Figure 2B:
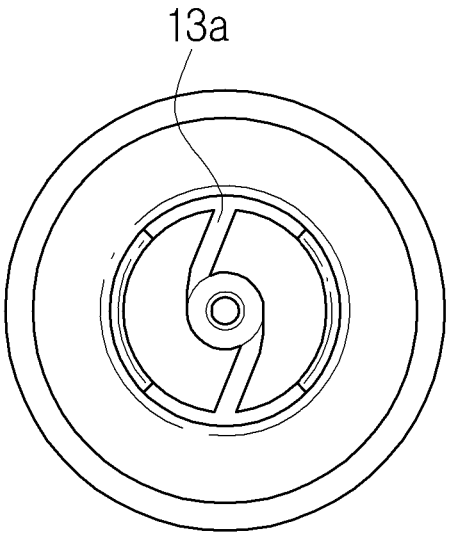
FIG. 2*b* is a bottom plan view of the nozzle body of the micro fogging device according to the preferred embodiment of the present invention.
Figure 3:
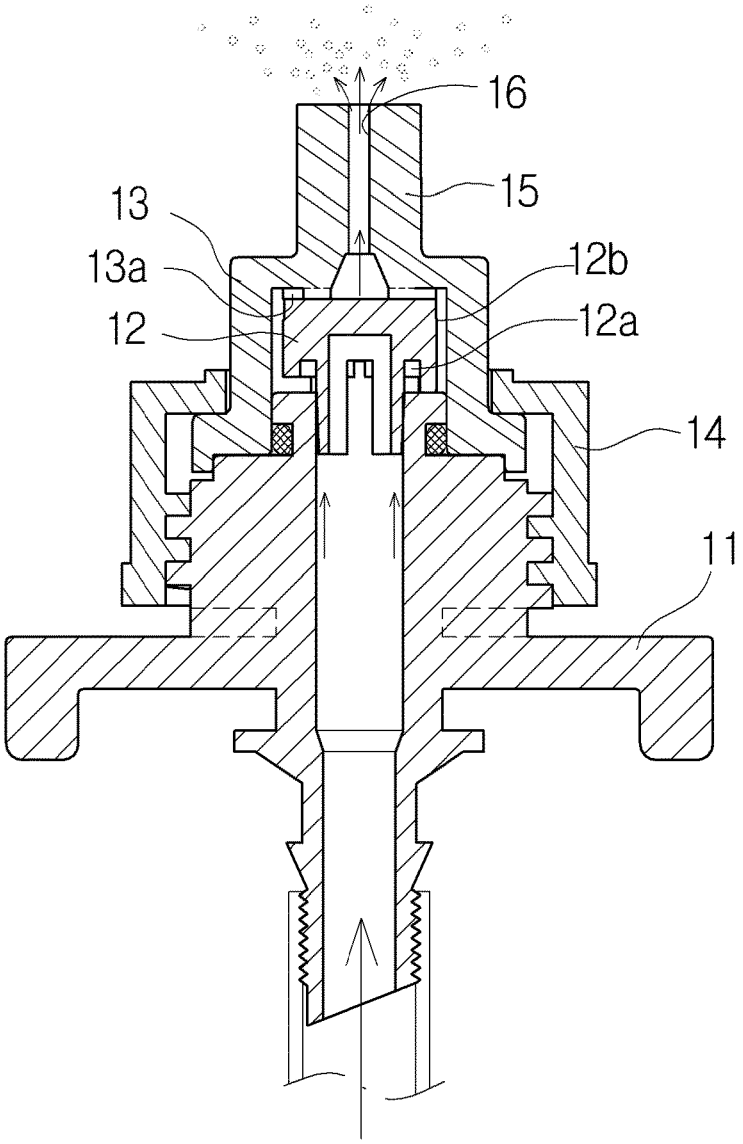
FIG. 3 is a sectional view of a low pressure fogger applied to the present invention.

FIG. 1 is a perspective view showing an outward appearance of a micro fogging device according to a preferred embodiment of the present invention, FIG. 2 is an exploded perspective view of the micro fogging device according to the preferred embodiment of the present invention, FIG. 2*a* is a bottom prospective and sectional view of the nozzle body of the micro fogging device according to the preferred embodiment of the present invention, FIG. 2*b* is a bottom plan view of the nozzle body of the micro fogging device according to the preferred embodiment of the present invention, and FIG. 3 is a sectional view of a low pressure fogger applied to the present invention.

As shown in the drawings, the micro fogging device 1 according to the present invention includes: a low pressure fogger 10 for first pulverizing and spraying water (fluid) supplied at low pressure; and a venturi nozzle 20 for second pulverizing the first pulverized water particles supplied from the low pressure fogger 10 into fog-like particles using the venturi tube principle.

The low pressure fogger 10 according to the present invention serves to first pulverize water supplied, and may be one of various kinds of low pressure fogs on the market.

The low pressure fogger illustrated in FIGS. 1 to 3 is a prior application for registration invented and filed by the same inventor as the present invention with Korean Patent Application No. 10-2014-0183526 and is configured to form fog at a low pressure (in the range of 2 to 3 kg/cm$^2$). The low pressure fogger 10 includes: a fogging device body 11; a fluid induction member 12 seated on the upper part of the fogging device body 11; a nozzle body 13 for sealing the upper part of the fluid induction member 12; and a contacting nut 14 screw-coupled to the fogging device body 11 in order to press the nozzle body 13 toward the fluid induction member 12. The low pressure fogger 10 forms fog by induction of the fluid induction member 12 and the nozzle body 13.

In the present invention, a coupling pipe 15 having a nozzle hole 16 formed therein is formed long in front of the nozzle body 13 of the low pressure fogger 10. In this instance, the coupling pipe 15 is tapered in such a way that its diameter becomes gradually smaller toward the end thereof.

The low pressure fogger 10 discharges water particles to the nozzle hole 16, which is disposed inside the coupling pipe 15 formed in front of the nozzle body 13, in a fog state (discontinuous state).

In the micro fogging device 1 according to the present invention, the fluid induction member 12 or the nozzle body 13 of the low pressure fogger 10 or the venturi nozzle 20 is molded with synthetic resin. Therefore, before molding, a silver nano material or an antimicrobial is put in the raw material.

1 to 2 parts by weight of the silver nano material or antimicrobial is put in 100 parts by weight of a polymer material. Because the technology to mix the silver nano material to the polymer material (HDPE or others) has been widely known, a detailed description will be omitted.

When the fluid induction member 12 or the nozzle body 13 of the low pressure fogger 10 or the venturi nozzle 20 is molded, it can prevent inhabitation of germs by the silver nano material and antimicrobial even though water remains inside the fluid induction member 12 or the nozzle body 13 of the low pressure fogger 10 or the venturi nozzle 20.

Figure 4:
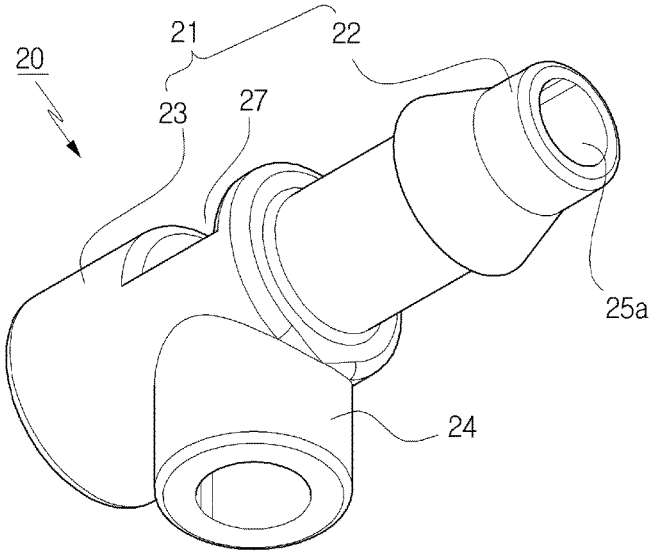
FIG. 4 is an enlarged bottom side perspective view of a venturi nozzle applicable to the present invention.
Figure 5:
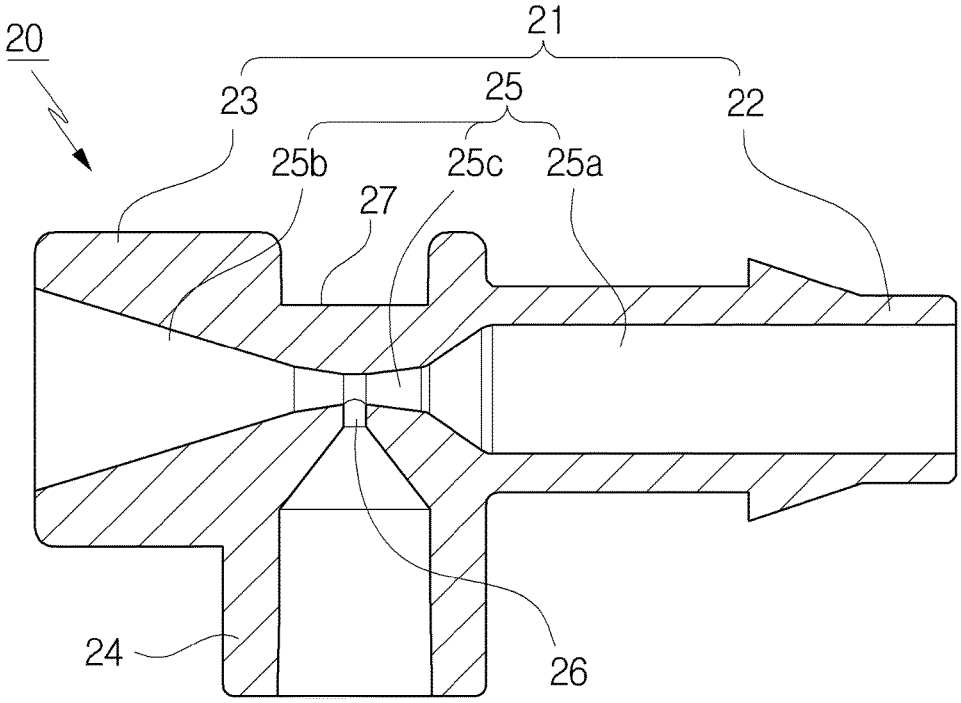
FIG. 5 is a sectional view of FIG. 4.

FIG. 4 is an enlarged bottom side perspective view of a venturi nozzle applicable to the present invention, and FIG. 5 is a sectional view of FIG. 4.

The venturi nozzle 20 applied to the present invention includes a body 21 formed by a first coupler 22, to which a compressed air supply pipe 30 for providing compressed air is coupled, and a spray pipe 23 formed in a straight type with the first coupler 22; and a second coupler 24 which is formed at right angles to the first coupler 22 and to which the coupling pipe 15 formed integrally with the nozzle body 13 of the low pressure fogger 10 is fit.

An inflow hole 25*a* is formed in the inside of the first coupler 22 and the spray pipe 23 for allowing inflow of compressed air, an expansion part 25*b* is formed in the inside of the spray pipe 23, and a throttle ring 25*c* is formed on the boundary between the inflow hole 25*a* and the expansion part 25*b*, so that a venturi tube 25 is formed to reduce pressure of the compressed air supplied through the inflow hole 25*a* and increase conveying speed. A flow path 26 communicating with the coupling pipe 15 of the low pressure fogger 10 coupled to the second coupler 24 is formed in the throttle ring 25*c*.

Moreover, a joining recess 27 is concavely formed between the first coupler 22 and the spray pipe 23. Joining means, such as a PP band, is inserted and fixed into the joining recess 27 when there is a need to fix the joining means in the state where the venturi nozzle 20 is connected to the low pressure fogger 10. Therefore, the joining recess 27 can solve the problem that the joining means is exposed to the outside.

Figure 6:
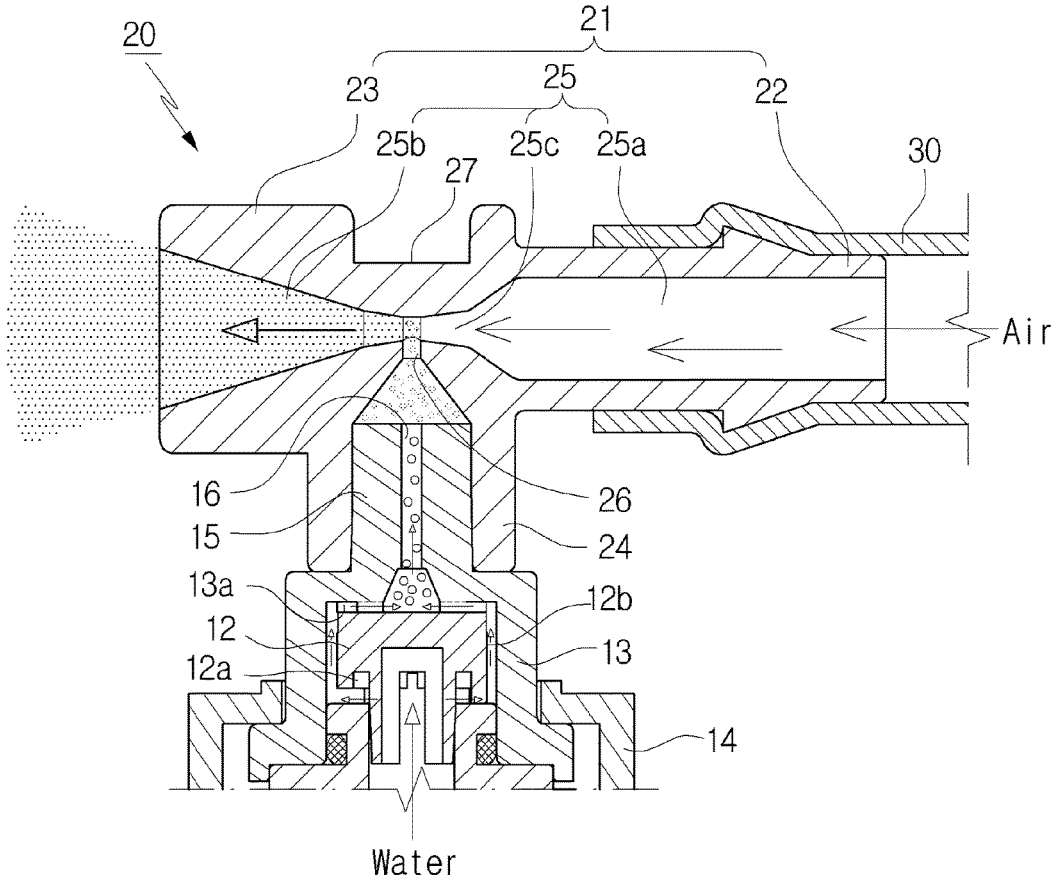
FIG. 6 is a sectional view showing an operational state of the micro fog provided by the present invention.

FIG. 6 is a sectional view showing an operational state of the micro fog provided by the present invention.

A micro fogging method using the micro fogging device 1 according to the present invention includes: a first step of first pulverizing water to form water particles of a sprayed state in the low pressure fogger 10; and a second step of second pulverizing the first pulverized water particles using the venturi nozzle 20 to form mist-like micro fog.

When water is supplied by the low pressure fogger 10, the water is first pulverized while passing the fluid induction member 12 seated on the upper part of the fogging device body 11 and the nozzle body 13, which seals the upper part of the fluid induction member 12, and then, the water particles are discharged out through the coupling pipe 15 formed integrally at the front of the nozzle body 13.

In other words, the water particles are supplied to vortex flow paths 13*a* of the nozzle body 13 through the flow path 26 formed in the fluid induction member 12. The vortex flow paths 13*a* are symmetric to each other and round portions of the '6'-shaped vortex flow path 13*a* and the '9'-shaped vortex flow path 13*a* are overlapped when they are viewed from the bottom. Therefore, the fluid supplied through the flow path 12*a* formed in the fluid induction member 12 flows in from both directions through the vortex flow paths 13*a* sealably supplied between a contact protrusion 12*b* and a fitting hole 17 in a state where the contact protrusion 12 gets in close contact with the upper face of the fitting hole 17, so that the fluids flowing from the both directions collide against each other, and are pulverized and sprayed while passing the nozzle hole 16 (First step).

The water particles pulverized in the first step are finely pulverized. In the present invention, when the coupling pipe 15 is coupled to the second coupler 24 of the venturi nozzle 20, the first pulverized water particles are pulverized again using compressed air provided from the compressed air supply pipe 30 coupled to the first coupler 22 to form mist-like micro fog.

That is, when compressed air is supplied through the compressed air supply pipe 30 toward the inflow hole 25*a* of the venturi tube 25, pressure of the compressed air becomes minimized and conveying speed becomes maximized while the compressed air passes the throttle ring 25*c*. In this instance, vibration is momentarily generated in the flow path 26 which is connected with the throttle ring 25*c* of the venturi tube 25 and communicated with the coupling pipe 15 formed on the nozzle body 13 of the low pressure fogger 10. So, the water particles discontinuously sprayed through the coupling pipe 15 are suddenly soaked into the throttle ring 25*c*, and then, is pulverized again while being discharged to the expansion part 25*b* inside the spray pipe 23 so as to form fog (Second step).

Therefore, because the low pressure fogger 10 and the venturi tube 25 of the present invention are made with a plastic material, the micro fogging device according to the present invention can be manufactured and spread at low prices, minimize water consumption and provide the best fogging capability because providing micro fog that cannot be supplied by the conventional fogging devices.

Figure 7:
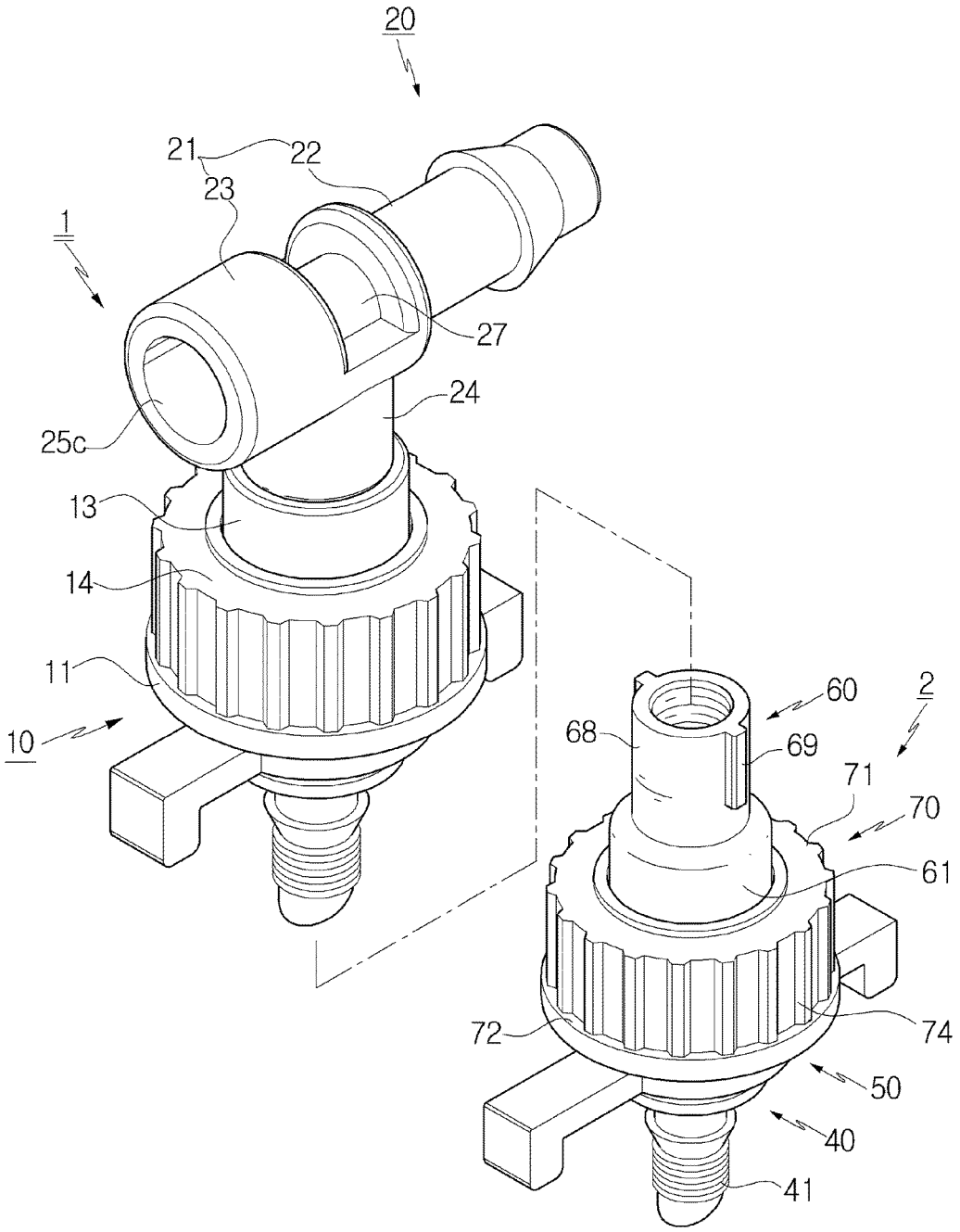
FIG. 7 is a perspective view showing an outward appearance of a micro fogging device for preventing a back flow of compressed air according to another preferred embodiment of the present invention.
Figure 8:
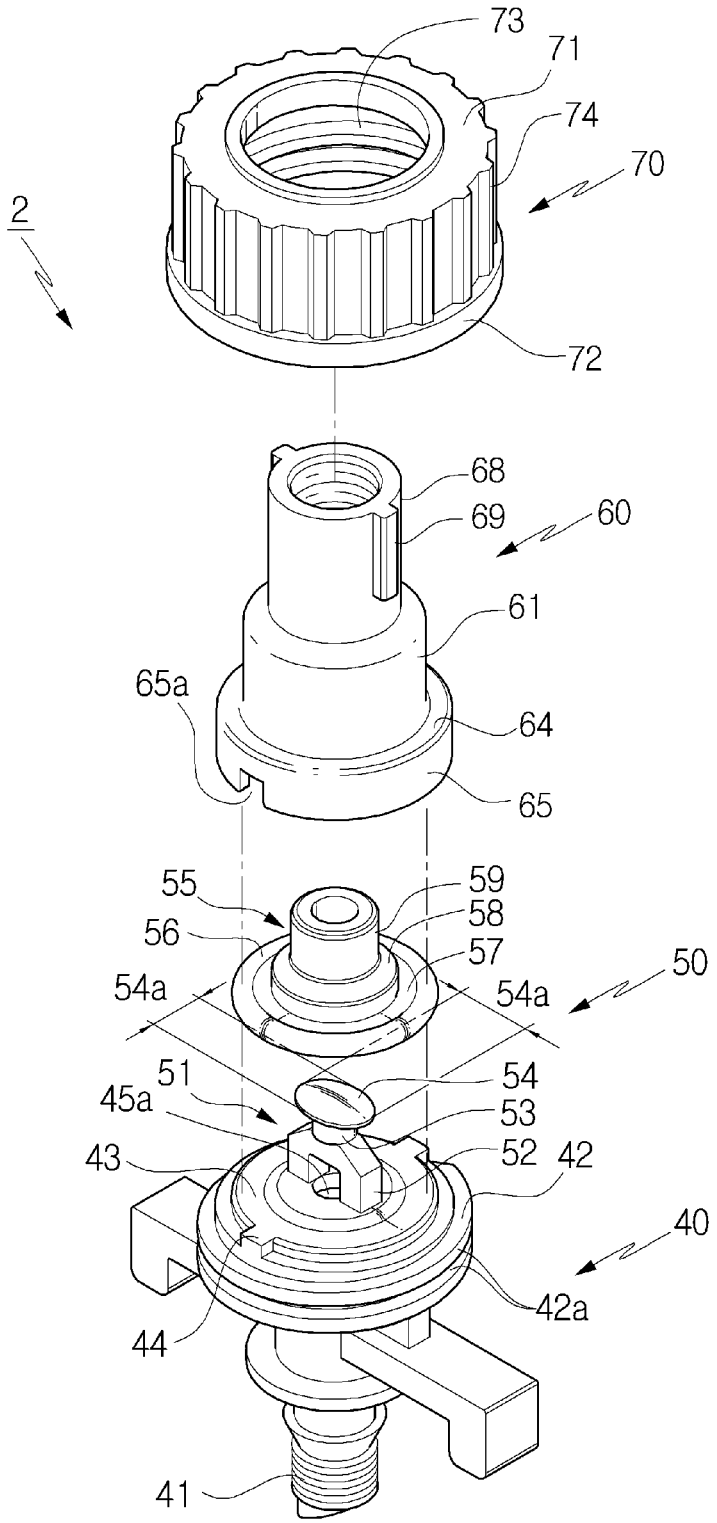
FIG. 8 is an exploded perspective view showing a micro fogging device of FIG. 7.
Figure 8A:
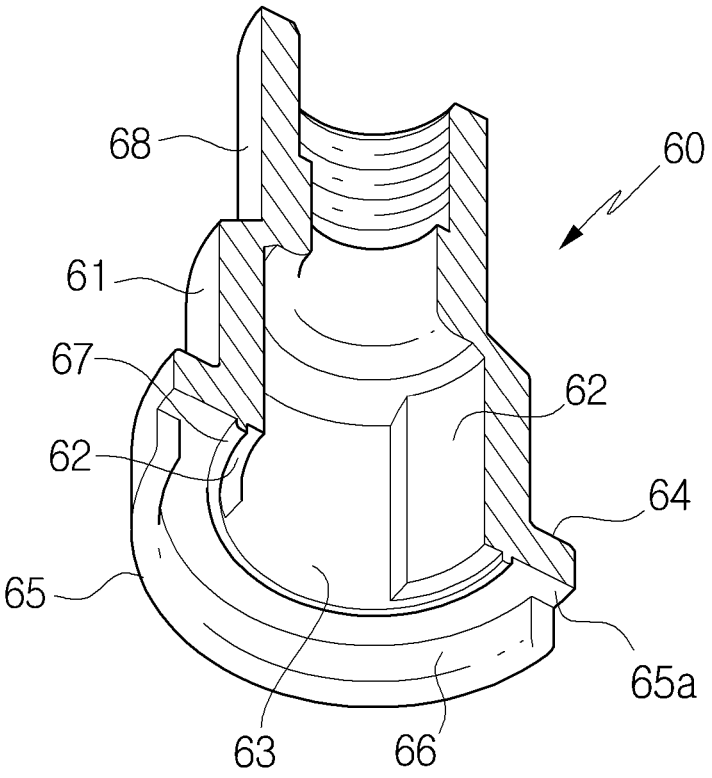
FIG. 8*a* is a bottom prospective and sectional view of the discharge housing of the micro fogging device according to another embodiment of the present invention.

FIG. 7 is a perspective view showing an outward appearance of a micro fogging device for preventing a back flow of compressed air according to another preferred embodiment of the present invention, FIG. 8 is an exploded perspective view showing a micro fogging device of FIG. 7, and FIG. 8*a* is a bottom prospective and sectional view of the discharge housing of the micro fogging device according to another embodiment of the present invention.

In the meantime, the micro fogging device 1 according to the present invention further includes a back flow preventing device 2 which is connected between the micro fogging device 1 and a fluid pipe (H) for preventing a back flow of the compressed air into a fluid supply fastener 11*a* in order to prevent stoppage of the fluid pipe (H) by pneumatic pressure.

Such a back flow preventing device 2 includes a main body 40, opening and closing means 50, a discharge housing 60 and a locking nut 70.

The main body 40 includes: a hose connection tube 41 formed at a lower part thereof; a coupling body 42 which is formed on the outer peripheral surface of an upper side and has a screw thread 42*a*; a seating plate 43 upwardly protruding from an upper end of the coupling body 42 to be inwardly dented at a predetermined interval; at least one rotation preventing unit 44 upwardly protruding from the upper end edge of the coupling body 42 to come into contact with the outer peripheral surface of the seating plate 43; and a flow path hole 45 formed in the middle of the upper/lower part to be hollow.

The opening and closing means 50 includes: an opening and closing member 51 formed on the upper end surface of the seating plate 43 of the main body 43*a*; and an opening and closing tube 55 connected to the opening and closing member to open and close the flow path only in one axial direction to prevent a back flow of the fluid.

The opening and closing member 51 is a member to support the opening and closing tube 55. Opening and closing support rods 52 upwardly protrude at both sides of an upper end flow path hole 45*a* of the seating plate 43 to be on the horizon with the rotation preventing unit 44. A connection rod 53 of a predetermined length extends integrally with the upper side of the opening and closing support rods 52, and an opening and closing supporter 54 is formed integrally with the upper end of the connection rod 53.

The opening and closing supporter 54 includes a major axis part 54*a* and a minor axis part 54*b* whose diameters are different from each other. The diameter of the major axis part 54*a* is relatively wider than the minor axis part 54*b*, and the major axis part 54*a* of the opening and closing supporter 54 is formed to be in the same axial direction as the rotation preventing unit 44 of the main body 40.

The opening and closing tube 55 includes: a ground plate 57 having a ground ring 56 formed on the rim thereof so that the seating plate 43 is seated thereon; a support tube 58 which upwardly protrudes from the upper end of the ground plate 57 and to which the opening and closing support rods 52 are forcedly fit; and an opening and closing pipe 59 which upwardly extends from the support tube 58 and forcedly gets in contact with the outer peripheral surface of the opening and supporter 54 in order to open and close the flow path only in one axial direction according to discharge pressure of the fluid.

Preferably, such an opening and closing tube 55 is made with rubber or silicon with an elastic restoring force.

Furthermore, when the opening and closing pipe 59 of the opening and closing tube 55 comes into contact with the opening and closing supporter 54 having the major axis part 54*a* and the minor axis part 54*b*, tension which pulls the opening and closing pipe 59 in the direction of the major axis part 54*a* is generated at the major axis part 54*a* so as to form a stronger watertight structure.

The discharge housing 60 includes: a body 61 which is perforated to surround the outside of the opening and closing tube 55; contact protrusions 62 inwardly protruding from both sides of the inner peripheral surface of the body 61 to restrain expansion by getting in contact with the opening and closing pipe 59 abutting on the major axis part 54*a* of the opening and closing supporter 51; and an extended hole 63 which is inwardly dented from the inner peripheral surface of the body 61 intersecting with the contact protrusions 62 in order to make expansion easy in the outer peripheral surface direction by securing an expansion space 63*a* around the opening and closing pipe 59 abutting on the minor axis part 54*b* of the opening and closing supporter 54.

Additionally, the discharge housing 60 further includes: a stepped jaw part 64 which has a diameter larger than that of the body 61 and is formed beneath the body 61 to be connected to the upper end of the coupling body 42; a pressing rim 65 downwardly protruding from the rim of the lower end portion of the stepped jaw part 64 and having a rotation preventing groove 65*a* to which the rotation preventing unit 44 is inserted while the seating plate 43 of the main body 40 is forcedly fit; and a pressing groove 66 and a pressing protrusion 67 which are formed on the inner face of the pressing rim 65 so that the ground ring 56 of the opening and closing tube 55 is inserted tightly.

In addition, the discharge housing 60 further includes: a discharge pipe 68 which upwardly protrudes from the upper part of the body 61 and has a diameter smaller than that of the body 61 to discharge the fluid; and at least one separation preventing unit 69 which protrudes from the outer peripheral surface of the discharge pipe 68 to prevent separation when a hose is fixed.

The locking nut 70 is to closely fix the discharge housing 60 to the main body 40, and includes: a retaining ring 71 for pressing and fixing the discharge housing 60 to the coupling body 42 of the main body 40 when the stepped jaw part 64 is caught to the retaining ring 71 in a state where the discharge housing 60 penetrates into the center thereof; a locking rim 72 downwardly protruding from the rim of the retaining ring 71; a screw part 73 screw-coupled to the screw thread 42*a* of the coupling body 42 in the inner peripheral surface of the locking rim 72; and a non-slip protrusion 74 formed on the outer peripheral surface of the locking rim 72 in order to allow a user to easily lock and release with the hand.

Figure 9:
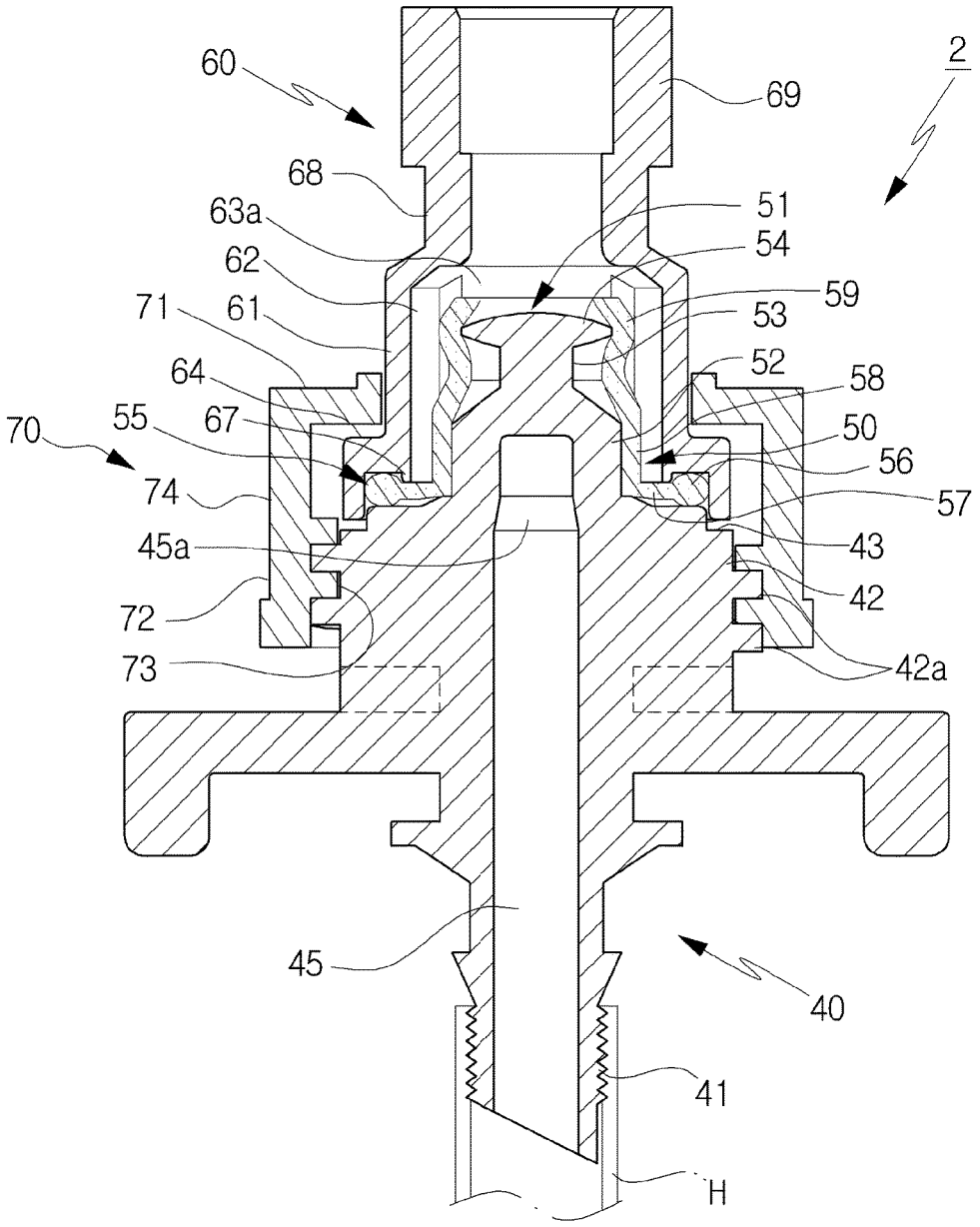
FIGS. 9 and 10 are sectional views showing a front face and a side face in a state where a back flow preventing device is assembled.
Figure 10:
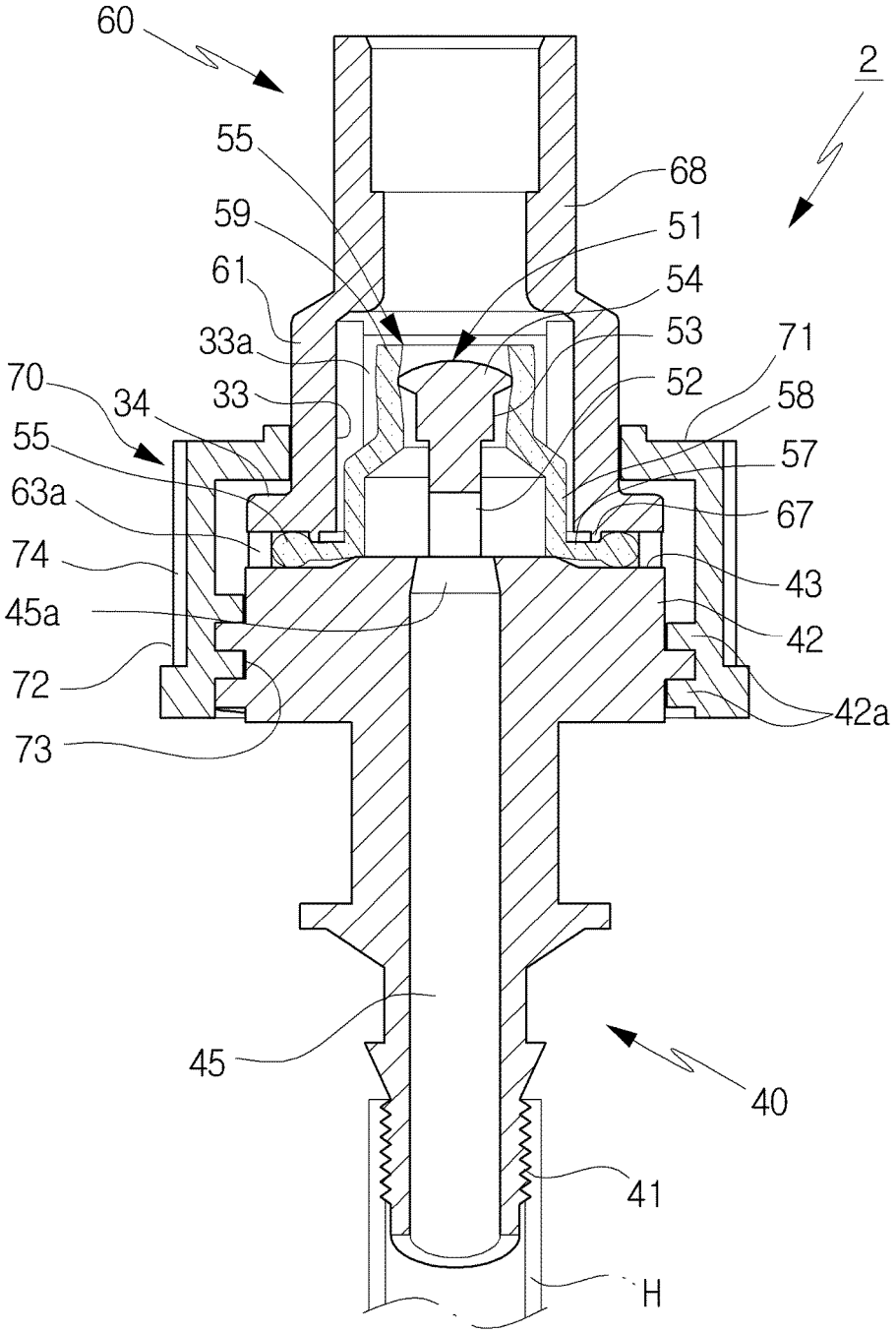

As shown in FIGS. 9 and 10, in the back flow preventing device 2, the opening and closing means 50 is formed when the opening and closing tube 55 is forcedly fit to the opening and closing member 51 formed integrally with the seating plate 43 of the main body 40. After that, the discharge housing 60 is covered on the outer face of the opening and closing tube 55 to be coupled with the main body 40, and then, the rotation preventing unit 44 of the main body 40 and the rotation preventing groove 65*a* of the discharge housing 60 are coupled to each other. The discharge housing penetrates into the locking nut 70 so that the stepped jaw part 64 of the discharge housing 60 presses the retaining ring 71 of the locking nut 70, and then, the locking nut 70 is screw-coupled to the coupling body 42 through a simple assembly.

In this instance, the round ring 56 of the opening and closing tube 55 is pressed in a state where it is inserted between the pressing groove 66 and the pressing protrusion 67 inside the pressing rim 65 of the discharge housing 60 in order to form a watertight state.

Figure 11:
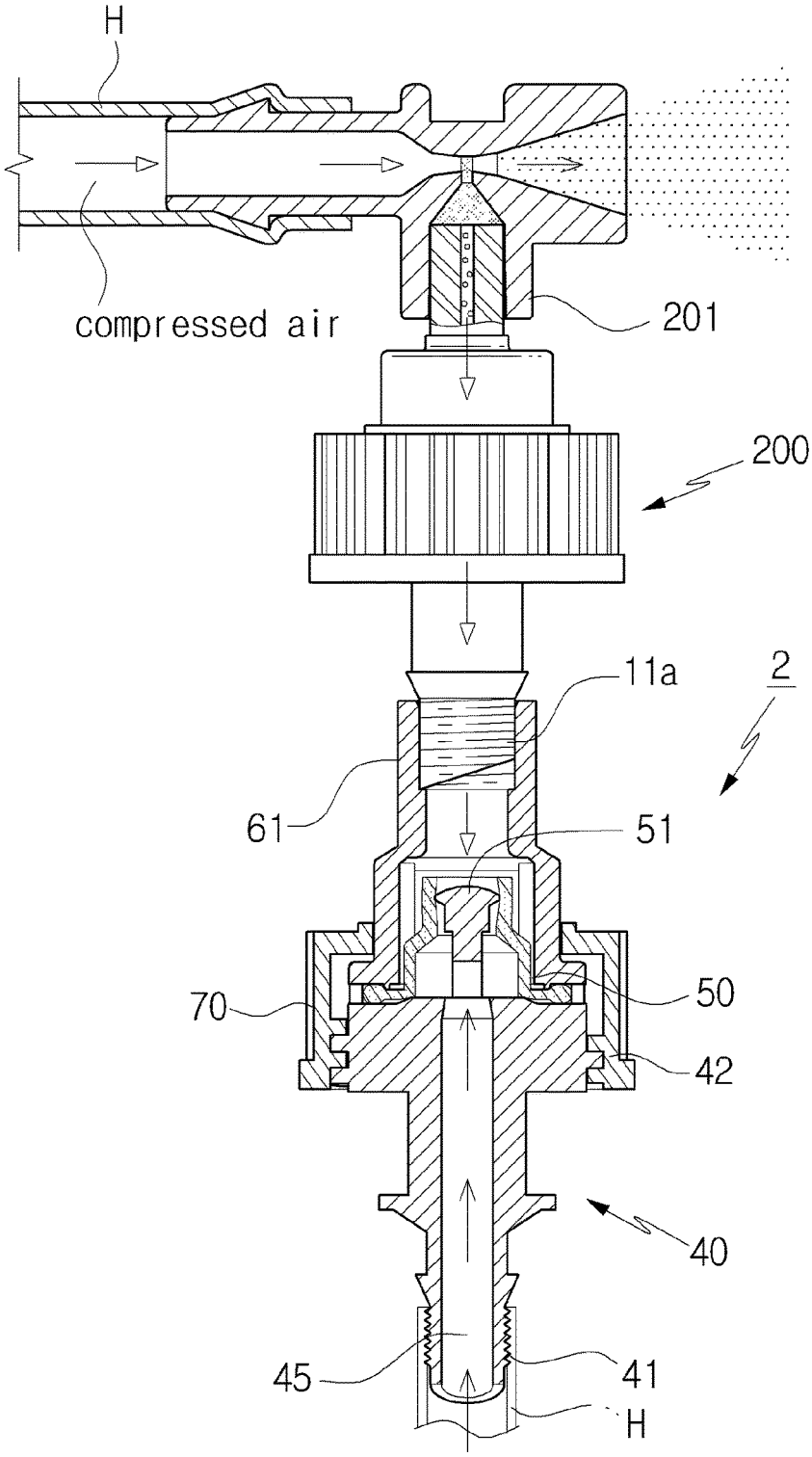
FIG. 11 is a sectional view showing an action of the micro fogging device by the back flow preventing device.

Moreover, as shown in FIG. 11, when the lower end part of the micro fogging device 1 is coupled to the upper end part of the back flow preventing device 2, they are simply coupled with each other by virtue of the screw thread formed on the fluid supply fastener 11*a* of the micro fogging device body 11 and the screw thread formed on the inner peripheral surface of the discharge housing 60. The fluid pipe (H) which is a fluid supply hose is connected to the hose connection tube 41 below the back flow preventing device 2.

Therefore, in a state where there is no flow of fluid, when the compressed air flows backward toward the part where the fluid is supplied, because the opening and closing pipe 59 of the opening and closing tube 55 is covered onto the opening and closing supporter 54 having the major axis part 54*a* and the minor axis part 54*b* inside the discharge housing 60 and is contracted in a watertight state, it can effectively prevent a back flow of the compressed air toward the fluid pipe (H).

Furthermore, when the fluid flows, discharge pressure by the fluid is formed in the opening and closing pipe 59 abutting on the opening and closing supporter 54 and expands, so that a fluid is supplied to the micro fogging device 1 while a gap is formed between the minor axis part 54*b* of the opening and closing supporter 54 and the opening and closing pipe 59.

Figure 12:
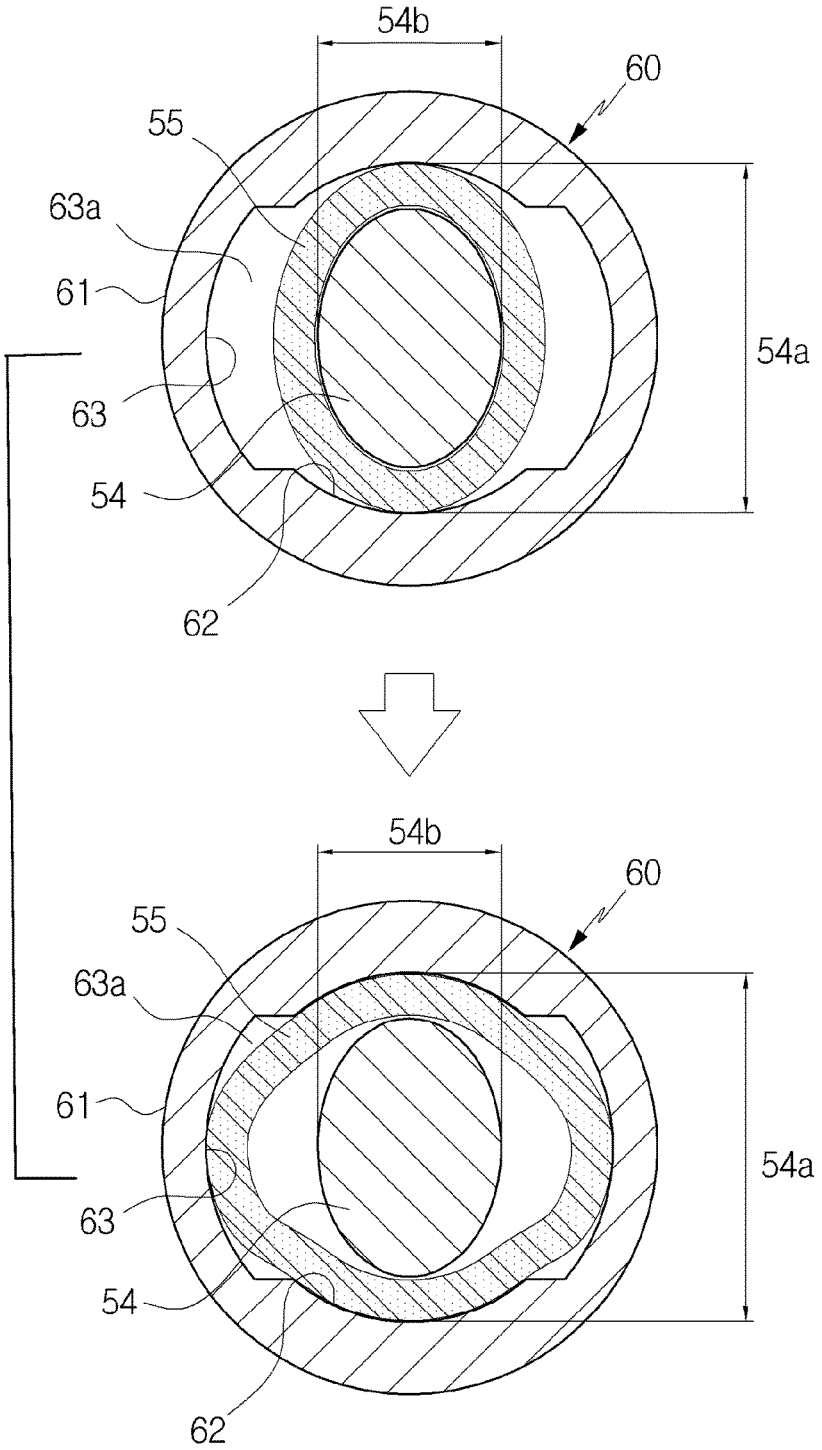
FIG. 12 is an enlarged cross-sectional plan view showing an action of opening and closing means of the back flow preventing device.

That is, in the state where there is no flow of the fluid, as shown in FIG. 12, the opening and closing pipe 59 comes into close contact with the opening and closing supporter 54 to form tension that the major axis part 54*a* pulls the opening and closing pipe 59. Accordingly, the micro fogging device according to the present invention can effectively prevent the back flow of the compressed air because contact force between the opening and closing supporter 54 and the opening and closing pipe 59 becomes stronger.

On the contrary, in the state where there is a flow of the fluid, because the major axis part 54*a* of the opening and closing supporter 54 presses in the state where the contact protrusion 62 of the discharge housing 3 comes into contact with the major axis part 54*a*, even though there is discharge pressure, it can prevent expansion. However, because the minor axis part 54*b* is located in the extended hole 63 of the discharge housing 3 to secure the expansion space 63*a*, the opening and closing pipe 59 abutting on the minor axis part 54*b* is expanded by the discharge pressure and forms a fluid path while being opened at the same time, so that the fluid can be smoothly supplied to the micro fogging device 1.

Figure 13:
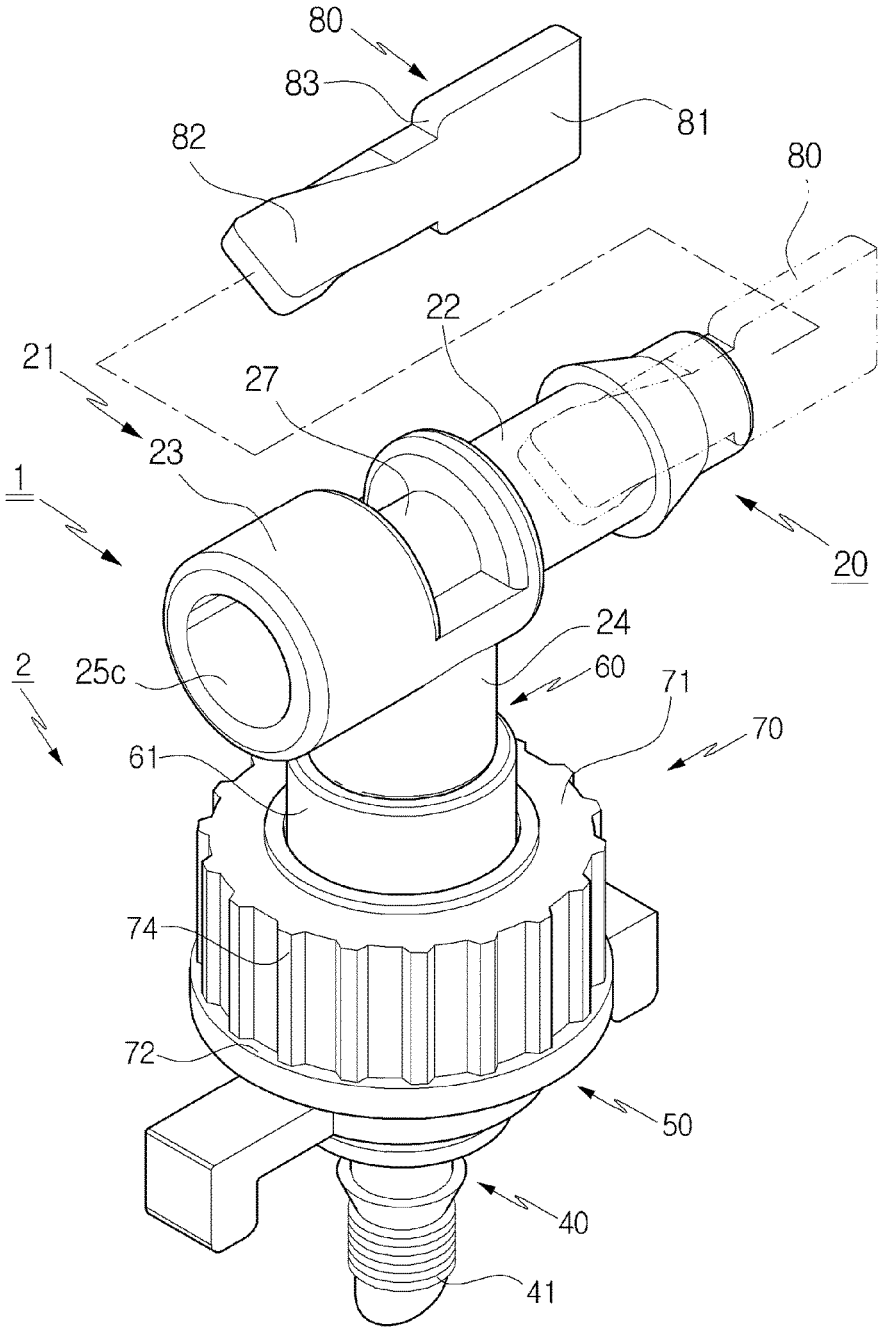
FIG. 13 is a perspective view showing an outward appearance of a micro fogging device for forming a vortex when fog is sprayed by the micro fogging device according to a further preferred embodiment of the present invention.
Figure 14:
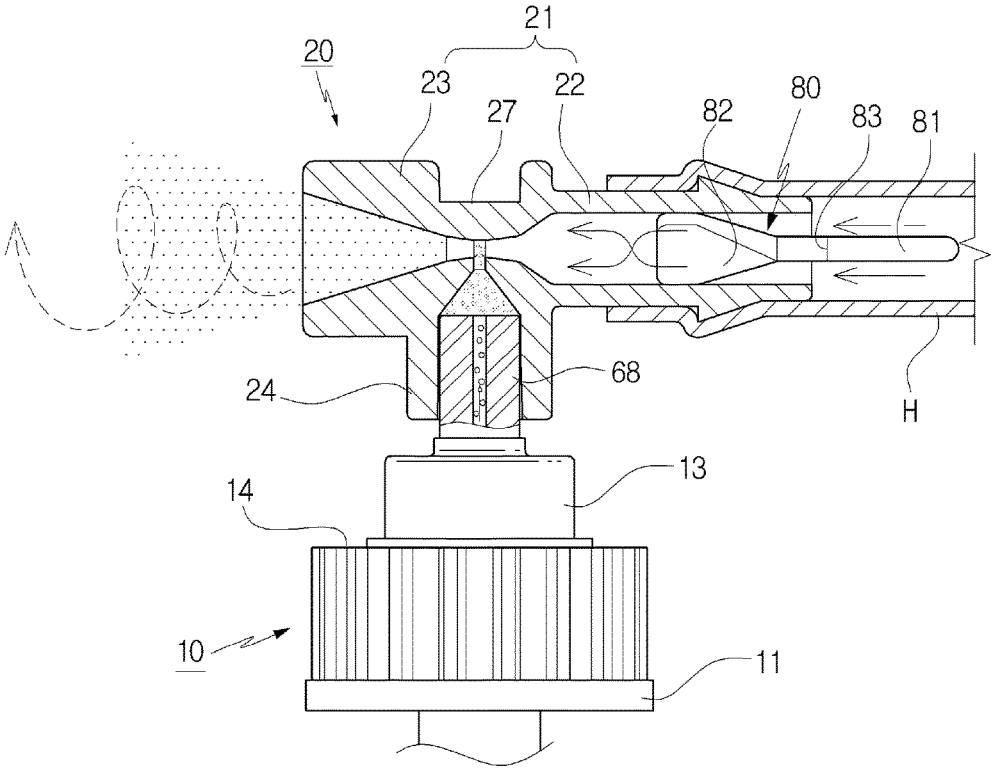
FIG. 14 is a sectional view showing an action of the micro fogging device of FIG. 13.

FIG. 13 is a perspective view showing an outward appearance of a micro fogging device for forming a vortex when fog is sprayed by the micro fogging device according to a further preferred embodiment of the present invention, and FIG. 14 is a sectional view showing an action of the micro fogging device of FIG. 13.

The micro fogging device 1 according to the present invention may further include a vortex pin 80 inserted into the inflow hole 25*a* through which the compressed air of the venturi tube 25 flows to form a vortex when fog is sprayed by the venturi nozzle 20 so as to provide uniform spraying toward the center when fog is sprayed by centrifugal force by the vortex.

The vortex pin 80 includes: a vertical division piece 81; a vortex piece 82 protruding from one end of the vertical division piece 81 in a twisted form; and a retaining jaw 83 formed by the vortex piece 82 which has a diameter smaller than that of the vertical division piece 82.

When the vortex pin 80 is inserted into the inflow hole 25*a* of the venturi nozzle, the vertical division piece 81 is located at the outside of the inflow hole by the retaining jaw and couples the compressed air supply pipe 30 to the first coupler 22.

Therefore, when compressed air is flown from the compressed air supply pipe 30, the compressed air is divided by the vertical division piece 81 and moves along the twisted form of the vortex piece 82 to form a vortex. After that, the compressed air passes through the venturi tube 25, so that the micro fogging device according to the present invention can uniformly spray fog by centrifugal force formed by the vortex when fog is sprayed from the spray pipe 23.

While the present invention has been described with reference to the particular illustrative embodiments, it is not to be restricted by the embodiments but only by the appended claims. It will be understood by those of ordinary skill in the art that various changes in form and details may be made therein without departing from the spirit and scope of the present invention, and the technical scope of the present invention will be defined by the following claims and equivalences.

What is claimed is:

1. A micro fogging device comprising:

a low pressure fogger unit for forming fog using water or liquid supplied to the fogger unit, the low pressure fogger unit including a nozzle boy, a coupling pipe extending from the nozzle body, and a nozzle hole formed through the coupling pipe to provide fog therethrough using water or liquid supplied to the fogger unit; and a venturi nozzle coupled to the low pressure fogger unit for providing micro fog using the fog provided by the low pressure fogger unit, the venturi nozzle including a first coupler with an inflow hole extending in a longitudinal direction, the inflow hole in fluid communication with compressed air, an expansion hole formed in the venturi nozzle at an opposite side from the inflow hole, and a throttle area between the inflow hole and the expansion hole, the throttle area having a diameter smaller than that of the inflow hole and the expansion hole, wherein the venturi nozzle further includes a second coupler extending at a right angle from the first coupler, with a flow path formed in the second coupler, the flow path in fluid communication with the throttle area of the venturi nozzle, wherein the coupling pipe of the low pressure fogger unit is coupled to the second coupler of the venturi nozzle, and as a consequence, fog provided through the nozzle hole of the low pressure fogger unit is finitely segmented or divided as the fog passes the throttle area of the venturi nozzle via the flow path in the second coupler, and thus, producing micro fog when the compressed air is provided through the inflow hole of the venturi nozzle, wherein the venturi nozzle has a vortex pin installed to the inflow hole of the venturi nozzle, the vortex pin extending longitudinally in the direction of the inflow hole and including a vortex piece of twisted shape configured to form a vortex to the compressed air provided through the inflow hole of the venturi nozzle, and consequently, to the micro fog discharging from the venturi nozzle, wherein the vortex pin further includes a vertical division piece at a proximal area of the vortex piece, and a retaining jaw formed between the vortex piece and the vertical division piece, and wherein the vortex piece has a cross-section smaller than that of the vertical division piece.

* * * * *